United States Patent [19]

Timmins et al.

[11] 4,411,039

[45] Oct. 25, 1983

[54] REMOVAL OF CONDENSED GAS FROM THE WALLS OF GAS PIPELINES

[75] Inventors: Cyril Timmins; John J. Templeman, both of Solihull, England

[73] Assignee: British Gas Corporation, England

[21] Appl. No.: 329,064

[22] Filed: Dec. 9, 1981

[30] Foreign Application Priority Data

Dec. 9, 1980 [GB] United Kingdom ..... 8039347

[51] Int. Cl.[3] ..... B08B 9/04

[52] U.S. Cl. ..... 15/104.06 R; 134/8

[58] Field of Search ..... 15/3.5, 104.06 R, 104.06 A; 134/8; 118/DIG. 10, 105

[56] References Cited

U.S. PATENT DOCUMENTS 3,708,819 1/1973 Breston ..... 15/104.06 R

*Primary Examiner*—Edward L. Roberts

*Attorney, Agent, or Firm*—Larson and Taylor

[57] ABSTRACT

A pipeline pig 21 for removing condensed gas from the wall of a pipeline 23 comprises a cylindrical body 22 which is a sliding fit in the pipeline 23 and has an axial passage 26 extending therethrough and a flow gas ejector inlet tube 37 extending into the passage 26. The passage 26 is formed with a venturi 27 and the tube 37 is formed with a restriction 38, the forward end of the tube 37 terminating upstream of the venturi 27. The pig 21 is propelled through the pipeline 23 by differential gas pressure acting upon it and gas flows through the passage 26 so that condensed gas is entrained into the passage 26 by way of an annular duct 32 and radial ducts 35 into a rear tapering portion 29 of the passage 26 upstream of the venturi 27. The condensed gas is drawn to the forward end of the ejector tube 37 which end is located downstream of the ducts 35 and is subjected to the turbulent flow of the flow gas which has been accelerated by the venturi restriction 38 in the ejector tube 37. The condensed or liquid gas is thus re-vaporized or returned into the dense phase in the case where the pipeline 23 is operated under dense phase conditions or alternatively mist or droplets of the condensed gas are dispersed in the gas flow through the pipeline. The use of the pig 21 thus avoids the necessity of the removal of a large slug of liquid gas from the pipeline as has been necessary with previous methods of removal of condensed gas from the wall of the pipeline 23.

17 Claims, 3 Drawing Figures

REMOVAL OF CONDENSED GAS FROM THE WALLS OF GAS PIPELINES

Figure 1:
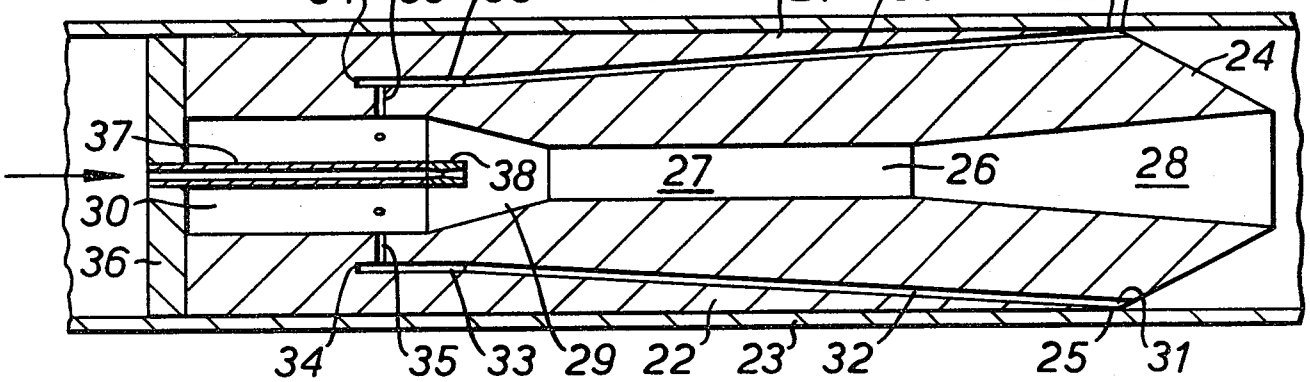

There is a tendency in some gas pipelines for the gas which is conveyed through the pipeline to condense on the wall of the pipeline and unless this condensed gas is removed, it tends to collect and form pools in the bottom of the pipeline or even to form a slug of liquid which obstructs the gas flow cross section of the pipeline to a substantial extent.

The problem of condensation of gas on the walls of pipelines occurs particularly with pipelines used for the collection of natural gas from gas fields and the conveyance of this gas to a collection installation. The condensation occurs because such pipelines are operated with the gas in the pipeline under such a temperature and a pressure that the gas is in the dense phase above the thermodynamic phase envelope of the gas.

In the dense phase, no separate gas or liquid phases can exist, but during operation there is a tendency for the gas in the pipeline under conditions such that it is at a point in the dense phase above the phase envelope to lose pressure isothermally so that the conditions move within the phase envelope and when this happens condensation occurs. The condensation of liquid on the wall of the pipeline restricts the flow through the pipeline thus increasing the pressure drop through the pipeline and causing even more gas to condense.

To correct the conditions under which such condensation occurs, the pipeline operator must reestablish the pressure level in the pipeline so that the pressure is again above the phase envelope. This will normally be done by reducing the rate of outflow from the pipeline whilst maintaining the rate of input. The pressure will then rise throughout the pipeline and if equilibrium were attained, the condensed gas would be taken back into the dense phase. However, in practice equilibrium does not obtain and once gas has condensed on the wall of the pipeline it cannot be completely removed by adjustment of the pressure in the pipeline and it is for this reason that the pools and slugs of liquid can occur.

The conventional technique for removing such liquid from a pipeline consists in launching spheres, which are a comparatively close fit in the pipeline, into the upstream end of the pipeline and these spheres are pushed through the pipeline by the gas pressure between them and each sphere sweeps a slug of liquid in front of it.

This technique clears the liquid from the pipeline, but it creates substantial problems in dealing with the slugs of highly volatile liquid which is swept by the spheres to the downstream end of the pipeline at the collection installation. The size of each individual slug cannot be determined and the slugs are difficult and may be hazardous to dispose of at the collection installation.

Accordingly, the aim of the present invention is to enable condensed gas to be removed from the wall of a gas pipeline in such a way that after removal the gas is entrained in the main gas flow through the pipeline. This gas may be in the dense phase if the pipeline is operated under dense phase conditions. In this way the necessity for disposing of a slug of liquified gas at the downstream end of the pipeline is avoided.

According therefore to the present invention, there is provided a pig for passage through a gas pipeline for removing condensed gas from the wall of the pipeline and for revapourising the gas or entraining mist or droplets in the gas flow through the pipeline, the pig comprising a body which fits in and is driven along the pipeline by differential gas pressure between the front and back of the pig, the body having condensed gas inlet means arranged to collect gas which has condensed in the pipeline and condensed gas outlet means arranged to receive the collected gas and discharge it into a flow gas duct which extends through the body of the pig so as to receive flow gas from the pipeline and discharge it in the pipeline ahead of the pig, the flow gas duct having a venturi for reducing the pressure of the gas flowing in the flow gas duct so that the condensed gas is sucked through the inlet and outlet means into the flow gas duct to be entrained by the gas flowing in the flow gas duct in the gaseous or dense phase or in the form of droplets for discharge in the pipeline ahead of the pig, the flow gas also including at least one flow gas inlet extending inwardly from the back end of the body and adapted to accelerate gas flowing thereinto from the pipeline.

Preferably the or each flow gas inlet includes a venturi to accelerate the gas entering the or each inlet.

Suitably the flow gas inlet comprises a tube extending into the passage.

Conveniently the front end of the tube terminates downstream of the condensed gas outlet means.

Preferably the front end of the tube terminates upstream of the venturi in the passage.

Suitably the condensed gas outlet means terminates upstream of the venturi in the passage.

Conveniently the venturi in the or each flow gas inlet is located closer to the front end of the inlet than to the back end.

In one embodiment of the invention the pig body is formed with an internal reservoir for storing condensed gas supplied by the condensed gas inlet means and for supplying the stored condensed gas to the condensed gas outlet means.

Suitably the internal reservoir is formed in an annular space between the outer wall of the pig and the wall of the flow gas duct.

Conveniently the reservoir is provided with a weir interposed between the condensed gas inlet means and the condensed gas outlet means.

Preferably the pig is formed at its front end between the outer wall of the pig and the flow gas duct with flow gas inlet means for supplying flow gas to the annular space.

Suitably the flow gas inlet means at the front of the pig comprise at least two inlets.

Conveniently a baffle is provided in the annular space to deflect gas entering at least one of the flow gas inlets.

Preferably a condensed gas overflow duct is provided, the overflow duct extending from the front end of the pig to the back end and having a non-return valve at its back end to allow excess condensed gas entering at the front end of the overflow duct to discharge at the back end but preventing the entry of flow gas into the overflow duct at the back end.

Suitably the condensed gas inlet means comprises at least one inlet duct disposed at the periphery of the pig.

Conveniently the condensed gas outlet means comprises at least one outlet duct leading to the flow gas duct.

Preferably, in order to assist the suction produced by the venturi in removing the liquid from the wall of the pipeline, there is a scraper extending around the periphery of the pig for scraping the condensed gas from the wall of the pipeline and the condensed gas inlet is annular and extends around the periphery of the pig in front of the scraper.

To enable an appreciable volume of condensed gas to be built up so that only condensed gas and little or no gas in the gaseous phase is sucked through the duct or ducts into the venturi, there is preferably an annular duct extending from the or each inlet rearwardly and inwardly towards the axis of the pig, the annular duct having a blind end in which, in use, the condensed gas collects, and further ducts extend from the annular duct upstream of the blind end to the passage. With this arrangement the blind end of the annular duct fills with the liquified gas under pressure up to a position beyond the further ducts and there is thus a reservoir of liquified gas from which the venturi is supplied through the further ducts.

Figure 2:
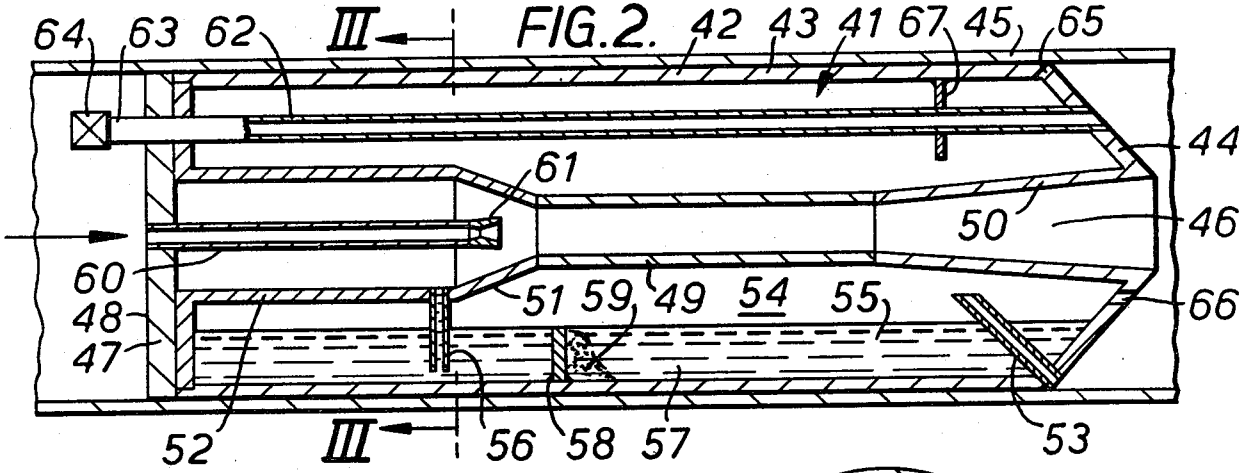
Figure 3:
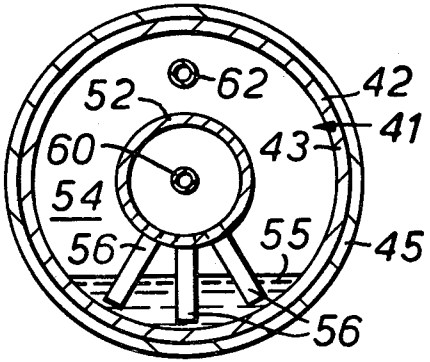

Embodiments of the invention will now be described with reference to the accompanying drawings in which FIG. 1 is a somewhat schematic diametric section through one form of the pig and through a portion of a gas pipeline, FIG. 2 is a schematic diametric section through another form of the pig and through a portion of the gas pipeline and, FIG. 3 is a section along the lines III—III of FIG. 2.

Referring to FIG. 1, the pipeline pig 21 has a cylindrical body 22, which is a sliding fit in the gas pipeline 23. The body 22 has a part conically tapering front end portion 24 and an annular edge 25, which forms a circular scraper, is formed around the forward end of the cylindrical body 22 at its junction with the front end portion 24.

A central passage 26 extends axially through the body 22 with a throat 27 forming a venturi between tapering front and rear portions 28 and 29. The tapering rear portion 29 leads to a cylindrical rear portion 30 forming the rear of the passage 26.

An annular condensed gas inlet 31 is formed just within the scraper 25 and an annular condensed gas duct 32 leads rearwardly and inwardly from the inlet 31. The rearward part 33 of the duct 32 extends axially to a blind end 34. For structural reasons the annular duct 32 is not quite continuous in a circumferential direction, but is traversed at intervals by structural ribs which interconnect the parts of the body 22 within and surrounding the duct 32.

A series of further radially extending ducts 35 lead from the annular duct 32 into the cylindrical rear portion 30 of the passage 26.

The rear end of the pig body 22 is closed by a centrally apertured disc 36 which is welded to the body 22. Extending through the disc aperture is a flow gas ejector tube 37 whose forward end terminates within the rear tapering portion 29 of the passage 26, that is, downstream of the ducts 35. The tube 37 is formed internally at a position close to its forward end with a restriction 38 forming a venturi.

In order to remove condensed gas from the wall of the pipeline, which in this case is a collection pipline leading from an undersea gas field to a shore based collecting installation and which operates under dense phase conditions, the pig 21 is inserted into the pipeline at its upstream end at the gas field. Flow gas under pressure flows into the passage 26 by way of the ejector tube 37 but before issuing into the rear tapering portion 29 of the passage 26 the gas is caused to accelerate in the tube venturi.

As the gas enters the venturi 27 there is an overall pressure drop through the passage 26 so that the gas pressure on the downstream side of the pig 21, that is the right hand side as seen in the drawing, is less than the gas pressure at the upstream side of the pig. Owing to the venturi shape of the passage 26, the pressure at the venturi throat 27 is less than the pressure in the pipeline downstream of the pig 21. The differential gas pressure acting on the pig 21 drives it to the right as seen in FIG. 1.

As the pig moves along the pipeline, the scraper 25 scrapes the condensed gas liquid from the wall of the pipeline and, owing to the reduced pressure in the throat 27, the liquid is sucked through the duct 32 and through the ducts 35 whence it is discharged into the rear portion 30 of the passage 26 and is caused to be drawn towards the forward end of the tube 37. The liquid gas is then struck by the flow gas accelerated by the tube 37 and is broken up into the dense phase or as small liquid droplets. The broken up gas is then dispersed in the gas flow in the pipeline 23 ahead of the pig 21.

The pig shown in FIG. 1 is suitable for use in a 24" external diameter pipeline where the flow gas pressure is may 2000 psi.

In this case the overall length of the pig is not itself critical but the condensed gas inlet 31 and ducts 32 and 35 should have a flow area of 0.0031 sq. ft. The diameter of the venturi throat 27 should be 2.18" and the taper angle of the front tapering portion 28 should be 10° with an outlet orifice diameter of 4.63". The length of both the venturi throat 27 and the front tapering portion 28 should be 14".

In the same way, the overall length of the tube 37 is not critical but the diameter of the nozzle throat restriction 38 should be 0.34" with an outlet taper angle of 10° and an outlet diameter of 0.71". Similarly the distance between the nozzle throat restriction 38 and the outlet or forward end of the tube 37 should be 2.11" while the distance between the forward end of the tube 37 and the upstream end of the venturi throat 27 should be 3.3".

The above values are based on the assumption that the pig is travelling at 5 ft/sec. and is removing a 1/16" film of liquid from the pipeline wall the liquid having a specific gravity of 0.6 and a molecular weight of 72.

Referring to FIGS. 2 and 3, in still another embodiment of the invention the pipeline pig 41 comprises a hollow generally cylindrical body 42 formed by an outer wall 43 which has a conically tapering front end portion 44. The pig is, as with the pigs shown in FIGS. 1 and 2, a sliding fit within the gas pipeline 45.

Extending through the body 42 is an axially disposed central flow gas duct 46. The duct 46 forms an integral front end connection with conical end portion 44 and is formed with a flanged rear end 47 which is joined to an apertured disc 48 which closes off the rear end of the body 42. The duct 46 forms a venturi 49 between its tapering front and rear portions 50 and 51 respectively, a cylindrical rear portion 52 forming the rear of the duct 46.

An upwardly and rearwardly directed inlet duct or pipe 53 for condensed gas is located between the junction between the pig body wall 43 and its front end portion 44 and forms a scraper for the condensed gas. The inlet pipe 53 terminates just short of the tapering front portion of the flow gas duct 46. The inlet pipe 53 leads to the annular space 54 between the pig body wall 43 and the flow gas duct 46, the annular space 54 forming a reservoir 55 for the condensed gas entering the pig body 42.

The flow gas duct 46 is provided at its rear end portion 52 with three circumferentially spaced but radially directed outlet ducts or pipes 56 (as show in FIG. 4) for supplying the condensed gas 57 from the reservoir 55 to the flow gas duct 46. As shown in FIGS. 3 and 4 the outlet pipes 56 terminate short of the outer wall 43 of the pig body 42 to permit the entry of condensed gas to the pipes 56.

The reservoir 55 is formed with a radially directed weir 58 secured to the wall 43 of the pig 41 and positioned between the inlet pipe 53 and the outlet pipes 56 to provide a barrier to the flow of debri which accompanies the condensed gas entering the reservoir 55 via the inlet pipe 53. As shown in FIG. 3 the debri 59 piles up against the weir 58.

In a similar fashion to the pig shown in FIG. 2, a flow gas ejector tube 60 extends through a central aperture in the disc 48, the ejector 60 having a forward and terminating within the rear tapering portion 51 of the flow gas duct 46, that is, downstream of the outlet pipes 56. The tube 60 is formed internally at a position close to its forward end with a restriction 61 forming a venturi.

Offset from the axis of the pig 41 is a condensed gas overflow pipe 62 which extends through the pig body 42 from its front end 44 and out through an axially offset aperture in the disc 48. The overflow pipe 62 is provided at its rear end 63 with a conventional non-return valve 64 permitting condensed gas to enter the pipe 62 at its front end 55 and to discharge from the pipe 62 at its rear end 63 but preventing flow gas entering the pipe 62 at its rear end 63.

As well as the condensed gas inlet pipe 53 the conical front end portion 44 is also provided with a flow gas inlet 65 adjacent its junction with the wall 43 of the pig 41 and diametrically opposite to the inlet 53. The end portion 44 is also provided with a further flow gas inlet 66 adjacent to the flow gas duct 46.

In use, as the pig 41 moves along the pipeline 45, condensed gas on the wall of the pipeline 45 is sucked into the reservoir 55 through the inlet pipe 53 owing to the reduced pressure in the venturi throat 49. This pressure is sufficient indeed to suck the liquid gas from the reservoir 55 through the outlet pipes 56 and into the rear portion 52 of the duct 46. This condensed gas is caused to be drawn to the forward end of the tube 60 where it is struck by the flow gas accelerated by the tube 60 and is broken up into the dense phase or as small liquid droplets. The broken-up gas is then dispersed in the gas flow in the pipeline 45 ahead of the pig 41.

The flow of the condensed gas 57 from the reservoir 55 through the outlet pipes 56 into the gas flow duct 46 is enhanced by the additional pressure exerted on the condensed gas 57 in the reservoir 55 by the flow gas entering the inlets 65 and 66. In order to increase the turbulence of the gas entering the inlet 65, a baffle plate 67 secured to the wall 43 of the pig body 42 deflects the gas after it enters the body 42.

Should there be a sudden and unpreductable build-up of condensed gas in the pipeline ahead of the pig 41 and the inlets 53 and 66 are incapable of removing it all, the excess gas is dispersed through the overflow pipe 62 whose purpose is to transfer such excess gas from the front to the back of the pig 41 where the excess gas can be revapourised by a following pig.

When either of the pigs shown in the drawings approaches the downstream end of the shore installation, the speed of the pig is reduced by braking devices and the pig is directed by a flap valve into a pig trap.

We claim:

1. A pig for passage through a gas pipeline for removing condensed gas from the wall of the pipeline and for revaporizing the gas or entraining mist or droplets in the gas flow through the pipeline, said pig comprising a body which fits in and is driven along the pipeline by differential pressure between the front and back of the pig, a flow gas duct located within the body of the pig and extending longitudinally thereof for receiving flow gas from the pipeline and including an outlet for discharging the flow gas in the pipeline ahead of the pig, the flow gas duct having a venturi so that the condensed gas is entrained into the flow gas duct in the gaseous or dense phase or in the form of mist or droplets for discharge in the pipeline ahead of the pig, flow gas inlet means, extending inwardly from the back end of the body and opening into said flow gas duct, for accelerating gas flowing thereinto from the pipeline for discharge into the flow gas duct, condensed gas inlet means extending into the body of the pig and arranged to collect gas which has condensed in the pipeline and condensed gas outlet means arranged to receive the collected gas and discharge the collected gas into the flow gas duct.

2. A pig as claimed in claim 1 in which the flow gas inlet means includes a venturi for accelerating the gas entering the flow gas inlet means.

3. A pig as claimed in claim 2, wherein said flow gas inlet means comprises a tube extending into the flow gas duct.

4. A pig as claimed in claim 3, in which the front end of the tube terminates downstream of the condensed gas outlet means.

5. A pig as claimed in claim 3 characterized in that the front end of the tube terminates upstream of the venturi in the flow gas duct.

6. A pig as claimed in claim 1 in which the condensed gas outlet means terminates upstream of the venturi in the flow gas duct.

7. A pig as claimed in claim 1 in which the venturi in the flow gas inlet means is located closer to the front end of the inlet means than to the back end.

8. A pig as claimed in claim 1 in which the pig body is formed with an internal reservoir for storing condensed gas supplied by the condensed gas inlet means and for supplying the stored condensed gas to the condensed gas outlet means.

9. A pig as claimed in claim 8, in which the internal reservoir is formed in an annular space between the outer wall of the pig and the wall of the flow gas duct.

10. A pig as claimed in claim 9 in which the pig is formed at the front end between the outer wall of the pig and the flow gas duct with flow gas inlet means for supplying flow gas to the annular space.

11. A pig as claimed in claim 10 in which the flow gas inlet means at the front of the pig comprise at least two inlets.

12. A pig as claimed in claim 11 in which a baffle is provided in the annular space to separate condensed gas and mist from the gas.

13. A pig as claimed in claim 8 in which the reservoir is provided with a weir interposed between the condensed gas inlet means and the condensed gas outlet means.

14. A pig as claimed in claim 1 in which a condensed gas overflow duct is provided, the overflow duct extending from the front end of the pig to the back end and having a non-return valve at its back end serving to allow excess condensed gas entering the front end of the overflow duct to discharge at the back end but preventing the entry of flow gas into the overflow duct at the back end.

15. A pig as claimed in claim 1 in which the condensed gas inlet means comprises at least one inlet duct disposed at the periphery of the pig.

16. A pig as claimed in claim 15 further comprising a scraper extending around the periphery of the pig for scraping off the condensed gas from the wall of the pipeline, the condensed gas inlet being annular and extending around the periphery of the pig in front of the scraper.

17. A pig as claimed in claim 1 in which the condensed gas outlet means comprises at least one outlet duct leading to the flow gas duct.

* * * * *